US006857949B2

(12) United States Patent
Reich et al.

(10) Patent No.: US 6,857,949 B2
(45) Date of Patent: Feb. 22, 2005

(54) ELECTRIC PORTABLE GRINDING MACHINE, PARTICULARLY AN ECCENTRIC GRINDER, PROVIDED WITH EDGE PROTECTION

(75) Inventors: Doris Reich, Stuttgart (DE); Steffen Wuensch, Holzgerlingen (DE); Joao Bergner, Aidlingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/332,838

(22) PCT Filed: Apr. 23, 2002

(86) PCT No.: PCT/DE02/01475

§ 371 (c)(1),
(2), (4) Date: Jan. 13, 2003

(87) PCT Pub. No.: WO02/098607

PCT Pub. Date: Dec. 12, 2002

(65) Prior Publication Data

US 2003/0148719 A1 Aug. 7, 2003

(30) Foreign Application Priority Data

Jun. 1, 2001 (DE) ..... 101 26 675

(51) Int. Cl.[7] ..... B24B 27/08
(52) U.S. Cl. ..... 451/357; 451/441; 451/359
(58) Field of Search ..... 451/158, 259, 451/270, 344, 353, 357, 359, 415, 424, 425, 441, 451, 452, 487, 508, 514, 516, 522, 533, 534, 537, 539

(56) References Cited

U.S. PATENT DOCUMENTS

| | | | | | |
|---|---|---|---|---|---|
| 3,864,784 | A | * | 2/1975 | Kilstrom et al. | 15/380 |
| 4,616,449 | A | * | 10/1986 | Marton | 451/456 |
| 5,018,314 | A | | 5/1991 | Fushiya et al. | |
| 5,292,352 | A | | 3/1994 | Rudolf et al. | |
| 5,445,558 | A | * | 8/1995 | Hutchins | 451/344 |
| 6,527,631 | B2 | * | 3/2003 | Wuensch et al. | 451/357 |

FOREIGN PATENT DOCUMENTS

| | | | | |
|---|---|---|---|---|
| DE | 42 26 741 | A | 2/1994 | |
| DE | 197 08 086 | A1 | 9/1998 | |
| DE | 200 16 263 | U | 10/2001 | |
| DE | 20016263 | U1 * | 10/2001 | B24B/9/08 |
| GB | 486 785 | A | 6/1938 | |

* cited by examiner

*Primary Examiner*—David B. Thomas
(74) *Attorney, Agent, or Firm*—Michael J. Striker

(57) ABSTRACT

An electrical power grinder, in particular an eccentric grinder, is disclosed that has a grinding wheel (14) and a grinding-medium holder (23), held on the underside thereof, of soft material. For the sake of reducing wear of the grinding-medium holder (23) at its outer edge and lengthening the service life of the grinding-medium holder, the grinding wheel (14) is provided with an edge guard, which has a guard member (30) encompassing the grinding wheel (14) that protrudes, in the plane of the grinding wheel, past the outer contour of the grinding-medium holder (23) (FIG. 3).

7 Claims, 1 Drawing Sheet

ELECTRIC PORTABLE GRINDING MACHINE, PARTICULARLY AN ECCENTRIC GRINDER, PROVIDED WITH EDGE PROTECTION

BACKGROUND OF THE INVENTION

The invention is based on an electrical power grinder, in particular an eccentric grinder.

In a known eccentric grinder (U.S. Pat. No. 5,018,314), the grinding-medium holder is a rubber body, secured to the grinding wheel, on whose underside a grinding sheet that contains the grinding medium is fixed replaceably, as a wearing part. The rubber body is clipped over the outer edge of the grinding wheel with an annular groove that is machined into the bottom of a central recess on the top, facing away from the grinding sheet, of the rubber body.

In an known oscillating grinder (German Patent Disclosure DE 197 08 086 A1), the grinding-medium holder, there called a grinding plate, is embodied in platelike form and is secured with screws to the grinding wheel, embodied as an oscillating plate; it protrudes at the periphery somewhat past the outer contour of the oscillating plate. The grinding-medium holder comprises a stiff top plate and a lower plate of soft material. A grinding sheet that contains grinding particles is detachably fixed to the underside of the lower plate by means of a surface adhesion connection.

SUMMARY OF THE INVENTION

The electrical power grinder of the invention has the advantage that because of the edge guard embodied on the grinding wheel, the outer edges of the grinding-medium holder, which is of soft material, are protected quite well in the grinding operation, particularly in the region where there are edges end graduations in the workpiece, and because the encompassing guard member protrudes past the grinding-medium holder, these outer edges cannot abut against the workpiece at any moment in the grinding operation. The wear of the grinding-medium holder is thus reduced to an extreme extent, and the service life of the grinding-medium holder is lengthened substantial. The guard member protruding in the plane of the grinding wheel past the outer contour of the grinding-medium holder can be an integral component of the grinding wheel, the latter being made preferably from plastic, or can be secured as a separate component, in the form of an encompassing edge, to the grinding wheel.

In a preferred embodiment of the invention, the guard member fits partly over the grinding-medium holder on the outer face thereof, and in the version where the guard member is integral with the grinding wheel, an angle element encompassing the grinding wheel protrudes axially with an encompassing leg past the underside, receiving the grinding-medium holder, of the grinding wheel. In the embodiment of the guard member as a separate component secured to the grinding wheel, an encompassing ledge is provided with an encompassing rib that extends axially past the underside of the grinding wheel.

The encompassing overfit edge of the grinding-medium holder thus created in both embodiments offers improved protection to the outer contour of the grinding-medium holder, even if the electrical power grinder should be unintentionally tilted.

BRIEF DESCRIPTION OF THE DRAWING

The invention is explained in further detail in the ensuing description in terms of exemplary embodiments shown in the drawing. Shown are.

DESCRIPTION OF THE EXEMPLARY EMBODIMENTS

Figure 1:
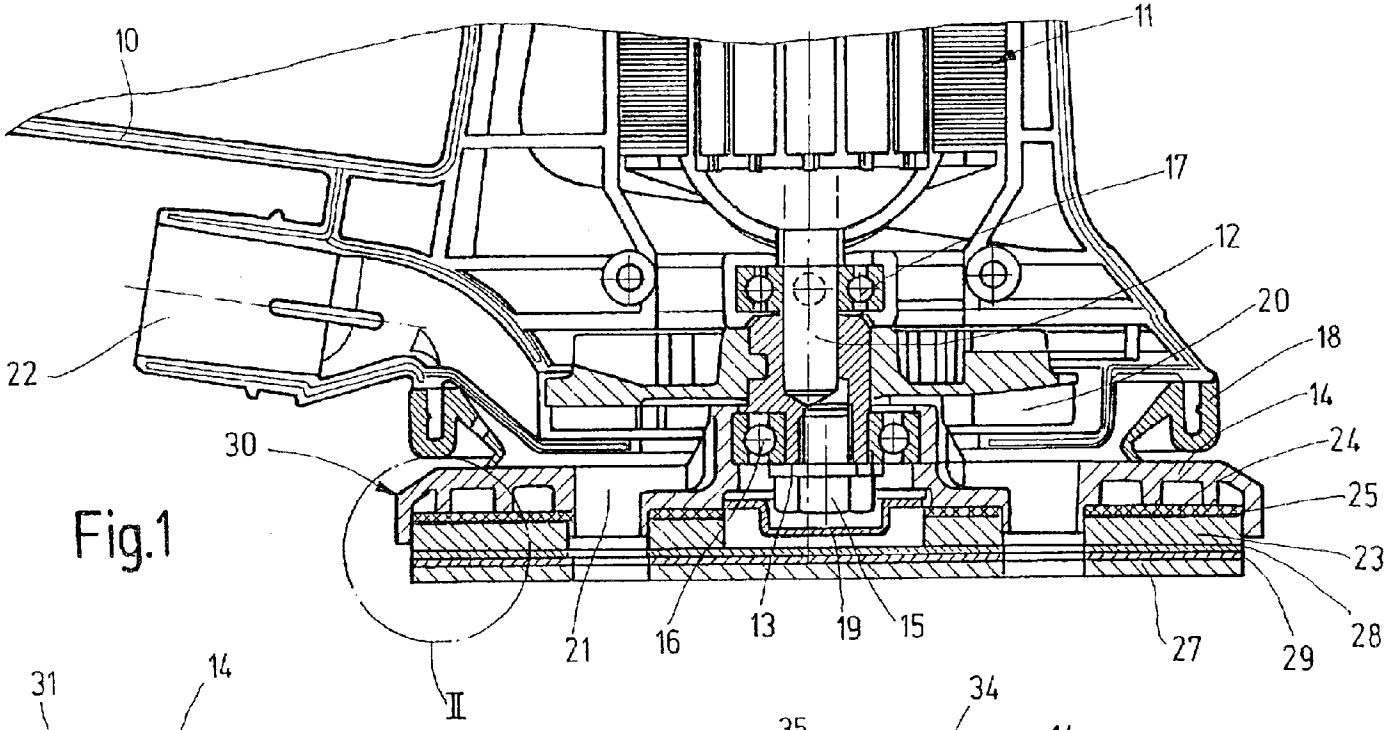
FIG. 1, a fragmentary longitudinal section through an eccentric grinder.

The eccentric grinder shown in fragmentary longitudinal section in FIG. 1 as an exemplary embodiment of a general electrical power grinder, which can for instance also be embodied as an oscillating grinder, has an electric motor 11 that is received in a housing 10 and drives a grinding wheel 14, via an eccentric element 13 secured to the rotor shaft 12 of the electric motor. The grinding wheel 14 is axially fixed to the eccentric element 13 by means of a fastening screw 15 screwed into the face end and is braced on the eccentric element 13 via a ball bearing 16 that is integrated with the grinding wheel 14, while the rotor shaft 12 is supported in the housing 10 by means of a ball bearing 17. To assure the above-described protective isolation, the fastening screw 15 is covered by a cap 19 that is retained in captive fashion in the grinding wheel 14 and that can be removed only by being destroyed. On the underside of the housing 10, oriented toward the grinding wheel 14, a rubber brake 18 for braking the grinding wheel 14 is embodied such that it protects the housing 10 from damage at its largest diameter. For extracting dust by suction, a fan 20 is secured to the rotor shaft 12; via dust extraction holes 21 in the grinding wheel 14, it aspirates air from the underside of the grinding wheel 14 and carries it to an air outlet stub 22, to which a dust collection filter is typically attached.

For the grinding machining of workpieces, a grinding-medium holder 23 of soft material, preferably rubber, is separably secured to the underside of the grinding wheel 14, which is injection-molded from plastic. To that end, the underside of the grinding wheel 14 is covered with a surface adhesion means 24, for instance with a hook strip, which together with a counterpart surface adhesion layer 25, such as loops that covers one disk face of the grinding-medium holder 23, produces a surface adhesion connection between the grinding wheel 14 and the grinding-medium holder 23. In the same way as in the grinding wheel 14, dust extraction holes 26 are machined into the grinding-medium holder 23, which when the grinding-medium holder 23 is correctly placed on the grinding wheel 14 are located congruently with the dust extraction holes 21 in the grinding wheel 14.

On the underside of the grinding-medium holder 23, facing away from the grinding wheel 14, a grinding sheet 29 that contains grinding particles is separably secured. The securing is again done via a surface adhesion connection, which like the surface adhesion connection between the grinding-medium holder 23 and the grinding wheel 14 is established by means of a surface adhesion means 28, disposed on the grinding-medium holder 23, and a counterpart surface adhesion means 29, disposed on the back side of the grinding sheet 27.

During workpiece grinding, to protect the soft grinding-medium holder 23 against striking edges, corners, or graduations in the workpiece, which would cause damage or wear of the outsides of the grinding-medium holder 23, the grinding-medium holder 23 is provided with an edge guard. This edge guard has a guard member 30 extending all the way around the grinding wheel 14, which protrudes in the plane of the grinding wheel past the outer contour of the grinding-medium holder 23 and partly fits over the grinding-medium holder 23 on the outer face 231 thereof.

Figure 2:
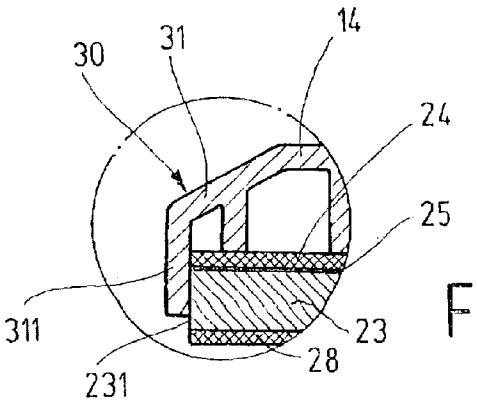
FIG. 2, an enlarged view of detail II in FIG. 1.

In FIG. 2, the detail II in FIG. 1 is shown enlarged, with the grinding sheet 27 removed. The guard member 30 is an integral component of the grinding wheel 14 and is injection-molded jointly with it. It has an encompassing angle element 31, which with an encompassing leg 311 protrudes axially past the underside, receiving the grinding-medium holder 23, of the grinding wheel 14 and thus partly fits over the outer face 141 of the grinding wheel 14.

Figure 3:
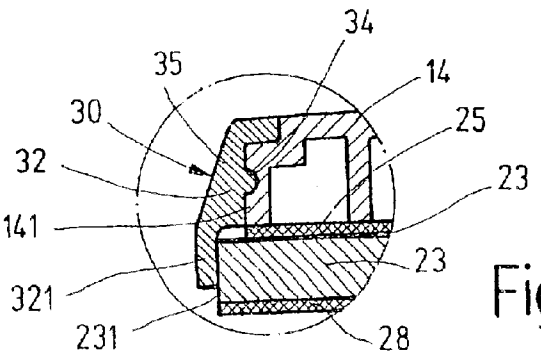
FIG. 3, a view the same as that in FIG. 2 but of a further exemplary embodiment.

In the further exemplary embodiment of the grinding wheel 14, shown enlarged in an identical detail in FIG. 3, the guard member is a ledge 32, extending all the way around, that is secured to the grinding wheel 14 and is of an elastic material, preferably rubber. The ledge 32 is clipped onto the encompassing outer edge 141 of the grinding wheel 14, and with a likewise axially extending, encompassing rib 321 protruding past the underside of the grinding wheel 14, it partly fits over the outer face 231 of the grinding-medium holder 23. The fixation of the ledge 32 to the grinding wheel 14 is done by means of a tongue-and-groove joint, to which end for which purpose an encompassing groove 34 is machined into the outer edge 141 of the grinding wheel 14, and on the face of the ledge 32 oriented toward the outer edge 141, a protruding, encompassing tongue 35 is formed on, which is pressed by positive and nonpositive engagement into the groove 34.

What is claimed is:

1. An electrical power grinder, in particular an eccentric grinder, having a grinding wheel (14), on whose underside a grinding-medium holder (23) of soft material is retained, characterized in that the grinding wheel (14) is provided with an edge guard, which has a guard member (30) encompassing the grinding wheel (14) that protrudes in the plane of the grinding wheel past the outer contour of the grinding-medium holder (23), that the guard member (30) fits at least partly over the grinding-medium holder (23), on the outer face (231) thereof, that the guard member (30) is an encompassing angle element (31), formed into the outside of the grinding wheel (14), that protrudes axially with one leg (311) past the underside, receiving the grinding-medium holder (23), of the grinding wheel (14), and that the grinding wheel (14) is injection-molded from plastic, and the angle element (31) with the leg (311) is injection-molded jointly with it in the injection-molding operation.

2. The electrical power grinder of claim 1, characterized in that the guard member (30) is an integral component of the grinding wheel (14).

3. The electrical power grinder of claim 1, characterized in that the guard member (30) is an encompassing ledge (32) secured to the grinding wheel (14).

4. The electrical power grinder of claim 3, characterized in that the ledge (32) is fabricated from an elastic material.

5. The electrical power grinder of claims 3, characterized in that the ledge (32) is clipped onto the outer edge (141) of the grinding wheel (14).

6. An electrical powergrinder, in particular an eccentric grinder, having a grinding wheel (14), on whose underside a grinding-medium holder (23) of soft material is retained, characterized in that the grinding wheel (14) is provided with an edge guard, which has a guard member (30) encompassing the grinding wheel (14) that protrudes in the plane of the grinding wheel past the outer contour of the grinding-medium holder (23), that the guard member (30) is an encompassing ledge (32) secured to the grinding wheel (14), and that the ledge (32) has an axially extending, encompassing rib (321) protruding past the underside, receiving the grinding-medium holder (23), of the grinding wheel (14).

7. An electrical power grinder, in particular an eccentric grinder, having a grinding wheel (14), on whose underside a grinding-medium holder (23) of soft material is retained, characterized in that the grinding wheel (14) is provided with an edge guard, which has a guard member (30) encompassing the grinding wheel (14) that protrudes in the plane of the grinding wheel past the outer contour of the grinding-medium holder (23), that the guard member (30) is an encompassing ledge (32) secured to the grinding wheel (14), that the ledge (32) is clipped onto the outer edge (141) of the grinding wheel (14), and that the clip connection between the ledge (32) and the grinding wheel (14) comprises an encompassing groove (34), machined into the outer edge (141) of the grinding wheel (14), and an encompassing tongue (35), which is formed onto the inner side, facing toward the outer face (131) of the ledge (32) and plunges by nonpositive and positive engagement into the groove (34).

* * * * *